US006010442A

United States Patent [19]

Lemons et al.

[11] Patent Number: 6,010,442

[45] Date of Patent: Jan. 4, 2000

[54] GOLF BALL WITH SECONDARY DEPRESSIONS

[75] Inventors: Lane D. Lemons, Easley; Matthew B. Stanczak, Westminster, both of S.C.

[73] Assignee: Dunlop Maxfli Sports Corporation, Westminster, S.C.

[21] Appl. No.: 09/220,085

[22] Filed: Dec. 23, 1998

Related U.S. Application Data

[60] Provisional application No. 60/068,896, Dec. 29, 1997.

[51] Int. Cl.[7] ..... A63B 37/14

[52] U.S. Cl. ..... 484/378

[58] Field of Search ..... 473/383, 384

[56] References Cited

U.S. PATENT DOCUMENTS

| | | | |
|---|---|---|---|
| 878,254 | 2/1908 | Taylor | 473/384 |
| 1,418,220 | 5/1922 | White . | |
| 4,346,898 | 8/1982 | Batke | 473/384 |
| 4,787,638 | 11/1988 | Kobayashi | 37/14 |
| 5,005,838 | 4/1991 | Oka | 473/384 |
| 5,087,049 | 2/1992 | Yamagishi et al. | 473/384 |
| 5,547,197 | 8/1996 | Pocklington | 473/384 |

*Primary Examiner*—George J. Marlo
*Attorney, Agent, or Firm*—Lorusso & Loud

[57] ABSTRACT

A golf ball having between 1,000 and 2,500 dimples and a plurality of secondary depressions between said dimples on the exterior surface thereof. The secondary depressions are of spherical cross section and may be uniformly or randomly placed on the surface of the ball. The secondary depressions are of a depth from 0.001" to 0.005" and a diameter from 0.01" to 0.05". The invention allows for decreased in-flight drag forces compared to a golf ball without the claimed secondary depressions.

3 Claims, 4 Drawing Sheets

GOLF BALL WITH SECONDARY DEPRESSIONS

CROSS REFERENCE TO RELATED APPLICATIONS

The present invention claims the benefit of U.S. Provisional Application Serial No. 60/068,896, filed Dec. 29, 1997, the teachings of which are incorporated herein by reference.

FIELD OF THE INVENTION

The present invention relates to golf balls, and in particular to a golf ball having secondary roughening depressions on the exterior surface thereof, resulting in improved aerodynamic performance.

BACKGROUND OF THE INVENTION

It has been known for many years to provide a golf ball with a plurality of dimples on the surface thereof in order to optimize the aerodynamic properties of the ball. In general, a ball without dimples would experience little or no lift forces in flight, while experiencing a very high drag force. By dimpling the surface the golf ball, not only is the drag force on an in-flight ball decreased, but a lifting force is also created.

Thus, while materials and construction of balls may change, all balls manufactured in the world today carry the familiar trend of an organized dimple pattern. These organized patterns are laid out on the ball so that air flow over the ball will be consistent regardless of the orientation of the ball upon impact. Generally, the dimples are laid out in different geodesic patterns such as icosahedrons (U.S. Pat. No. 4,090,716), octahedrons (U.S. Pat. No. 4,720,111), dodecahedrons (U.S. Pat. No. 4,722,529), icosadodecahedron (U.S. Pat. No. 4,729,567), cuboctahedron (U.S. Pat. No. 4,762,326), etc.

Through aerodynamic research on golf balls and the effects of varied dimple patterns, it has been determined that lift and drag forces are somewhat coupled. That is to say, any alteration of the lift force will produce some alteration in the drag force, and vice versa. Because of this direct relationship between lift and drag, the lift-to-drag ratio is essentially a compromise between the two aerodynamic forces to produce the best possible flight trajectory under the given design constraint. This compromise is necessitated by the inability of the designer to effectively decouple the lift and drag components of the aerodynamic force vector on a golf ball in flight.

Thus, there remains a long-felt need in the art for a golf ball design which allows greater flexibility in the aesthetic and aerodynamic characteristics of the ball than currently possible with conventional dimple patterns.

OBJECTS OF THE INVENTION

An object of the present invention is, therefore, to provide a golf ball design which allows greater flexibility in the usage of surface area coverage and dimple layout for creating desired aerodynamic effects.

Another object of the present invention is to provide a golf ball design which allows reductions in the drag force on a golf ball compared to current technologies and constraints.

Yet another object of the present invention is to provide a golf ball design which allows the lift and drag forces on an in-flight ball to be decoupled to a greater extent than possible with current designs.

Still another object of the present invention is to provide a golf ball design which allows greater flexibility in the usage of surface area coverage to create desired aesthetic effects.

These and other objects of the present invention will become apparent from a review of the description provided below.

SUMMARY OF THE INVENTION

The present invention is organized about the concept of combining conventional golf ball dimples with secondary depressions on the surface of the ball. The secondary depressions may be uniformly or randomly placed on the surface of the ball. Advantageously, the secondary depressions reduce the drag forces on the ball and allow for greater flexibility in aerodynamic and aesthetic design.

In particular, a golf ball according to the present invention includes an exterior surface defining a plurality of dimples and a land area between the dimples. A plurality of secondary depressions are defined in the land area. Dimensionally the depressions have a diameter less than about 0.05", preferably in the range from about 0.01" to about 0.03", and a depth in the range from about 0.001" to about 0.010", preferably in the range from about 0.001" to about 0.005". The secondary depressions preferably have a spherical radius, and are substantially identical in dimension and geometry. Typically, between about 1000 and 2500 of the secondary depressions are formed in the ball, with about 1820 depressions in one particular embodiment wherein the depressions have a diameter of about 0.0212" and a depth of about 0.004".

BRIEF DESCRIPTION OF THE DRAWING

For a better understanding of the present invention, together with other objects, features and advantages, reference should be made to the following description of the preferred embodiment which should be read in conjunction with the following figures wherein like numerals represent like parts.

DETAILED DESCRIPTION OF THE INVENTION

Presently, all golf balls are manufactured with some organized dimple pattern. The dimples themselves are usually circular in plan view, although polygonal dimple shapes have been used, such as triangular, rectangular, pentagonal, and hexagonal shapes. For ease of explanation, the invention will be described herein in connection with various embodiments having circular dimples arranged in a particular pattern. Those skilled in the art will recognize, however, that the features of the invention could be incorporated into golf balls having any dimple geometry and/or pattern. It is intended, therefore, that the invention not be limited to the specific embodiments described, but include any variation thereof associated with use in varied dimple geometries and/or patterns.

Figure 1:
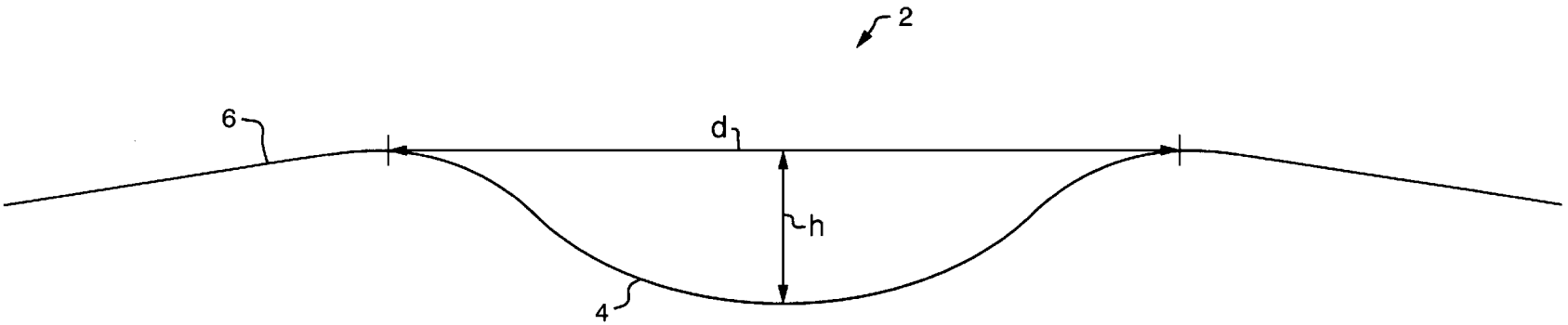
FIG. 1 (PRIOR ART)
FIG. 1: is a partial sectional view of a prior art ball showing a dimple therein.

Referring now to FIG. 1 of the drawing, there is shown a partial sectional view of a prior art golf ball 2, wherein a dimple 4 having a circular geometry (i.e. a spherical radius) is formed in the exterior surface of the ball. As is known, golf balls are generally formed in a two-part mold, which forms the dimples on the cover of the ball. The dimensions of the dimples 4 may vary with the dimple geometry and pattern. Typically, however, the diameter d of the dimple is greater than about 0.10" and height/depth h of the dimple is greater than about 0.007". The concave surface area 6 of the ball between dimples is commonly referred to as the "land" area of the ball.

Figure 2:
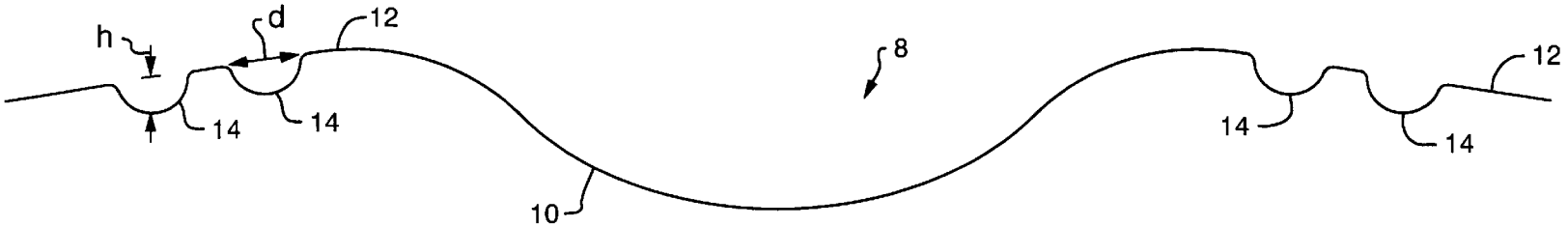
FIG. 2: is a partial sectional view of a ball according to the present invention showing a dimple and secondary depressions formed in the land area of the ball, i.e. in the concave surface area between the dimples.

In FIG. 2 there is shown a partial sectional view of a preferred embodiment of a ball 8 according to the present invention. The partial sectional view shows a dimple 10 and secondary depressions or roughening depressions 14 formed in the land area 12 of the ball. The secondary depressions are formed by the two-part mold during manufacture of the ball. The dimensions of the dimple correspond to the conventional dimensions of a dimple in a prior art ball such as that shown in FIG. 1. As shown in FIG. 2, the secondary depressions 14 are significantly smaller in diameter and depth than the dimples 10. The secondary depressions may be of any regular or irregular geometric shape, but typically have a spherical radius (i.e., circular in plan view), as shown.

Figure 4:
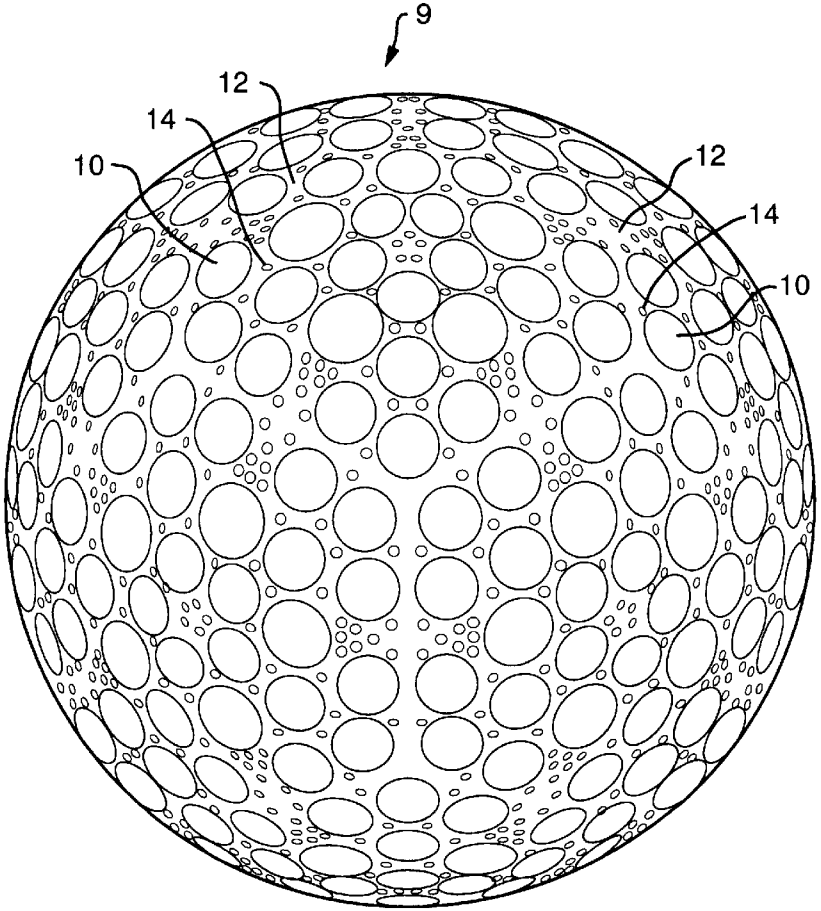
FIG. 4: is a pole view of the ball shown in FIG. 3.
Figure 3:
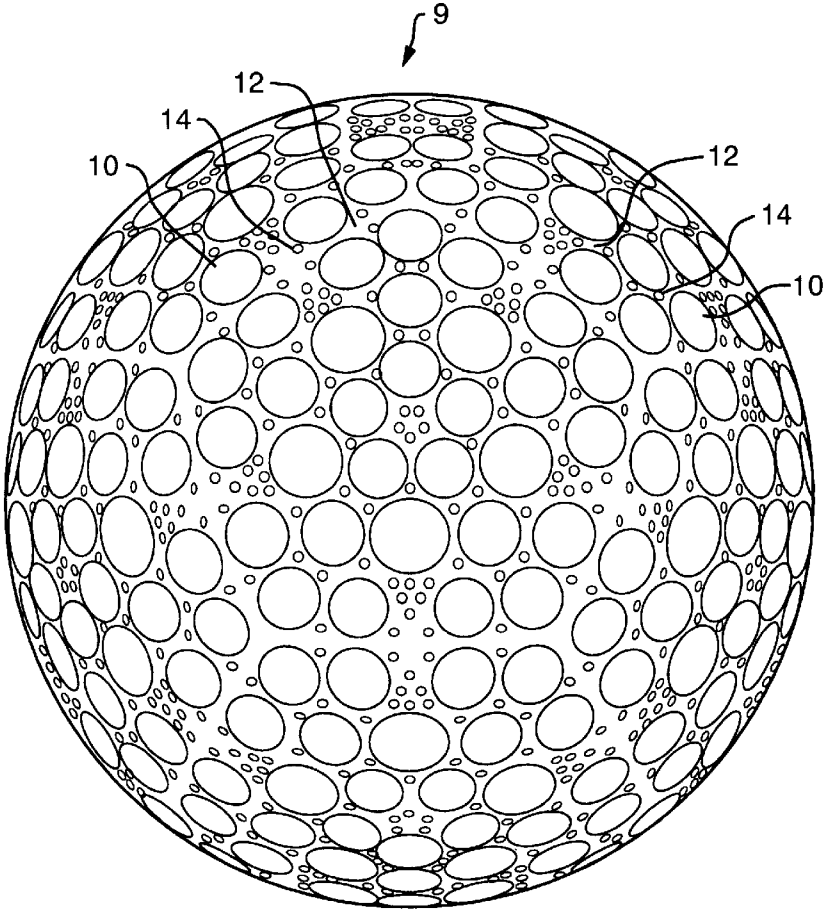
FIG. 3: is an equatorial view of the ball according to the invention having secondary depressions only in the land area of the ball.
Figure 5:
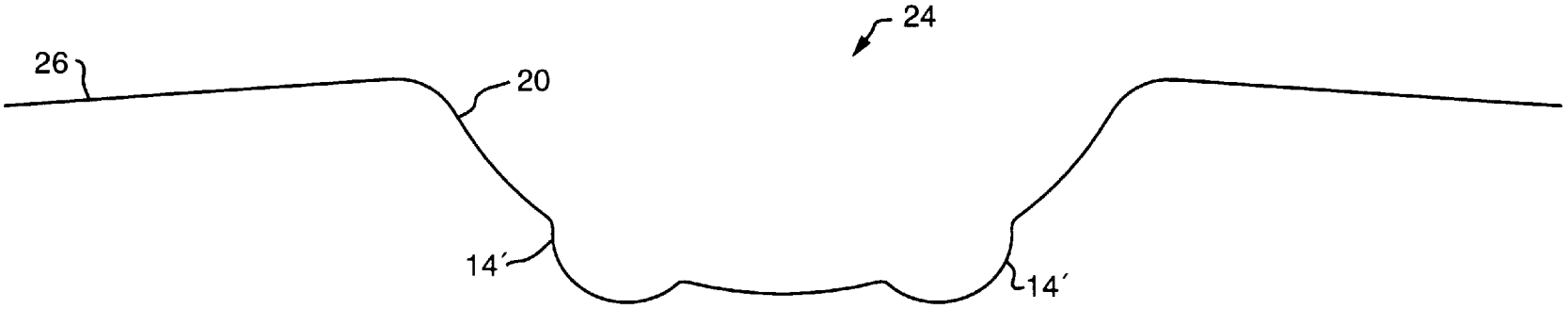
Figure 6:
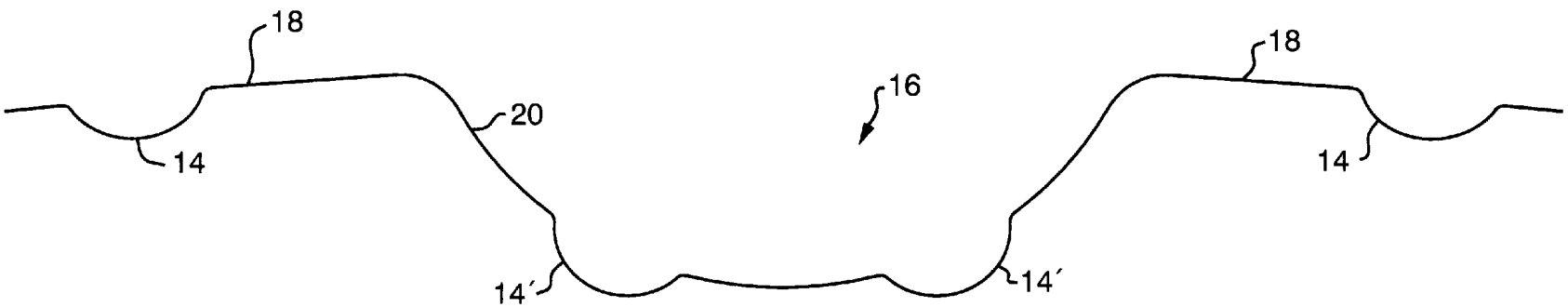
Figure 8:
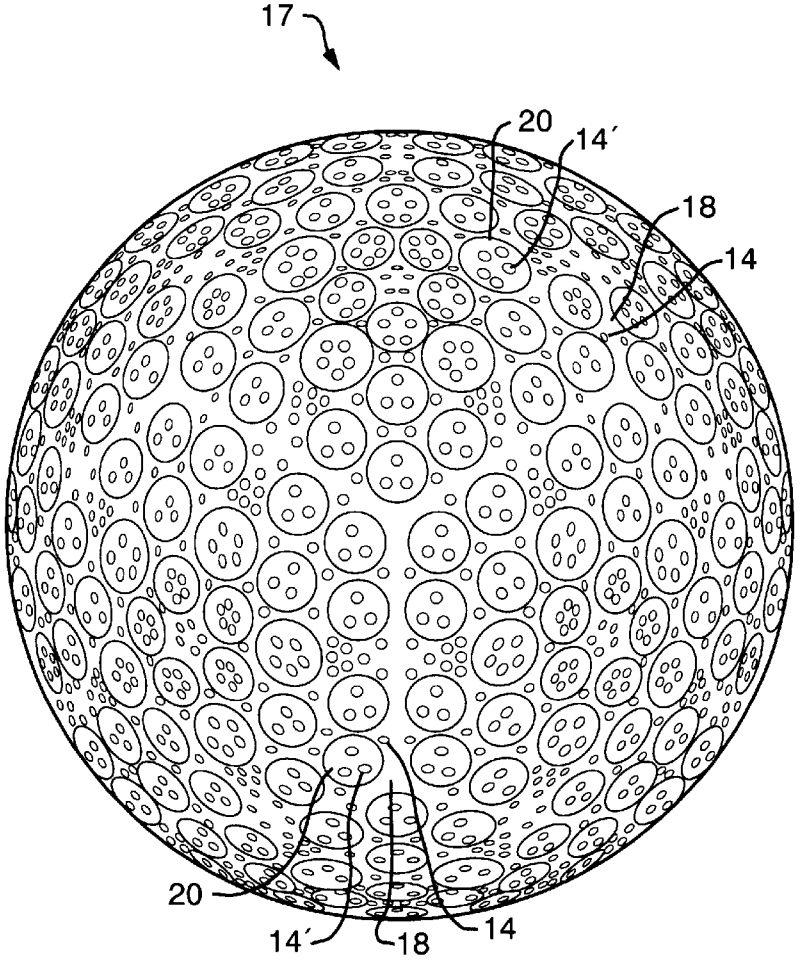
Figure 7:
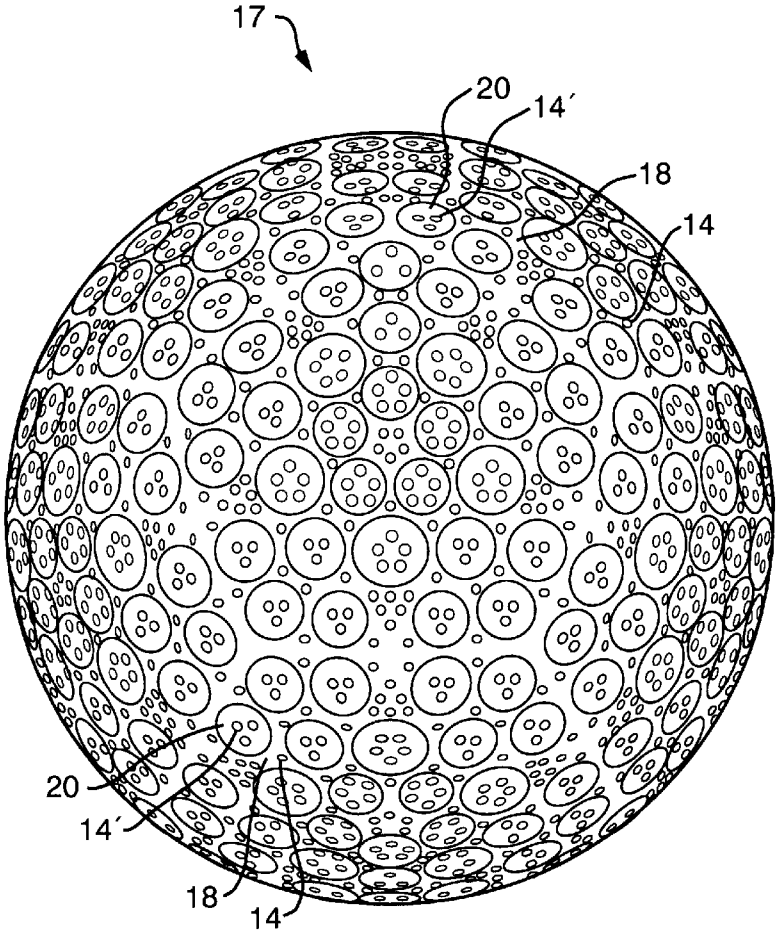

FIGS. 3 and 4 show equatorial and pole views, respectively, of a ball 9 according to the invention with dimples 10 arranged in a typical pattern and secondary depressions 14 disposed only in the land area 12 of the ball, as shown in FIG. 2. The positioning of the secondary depressions in the land area of the ball naturally depends on the dimple pattern. For a given dimple pattern, the secondary depressions 14 may be positioned randomly or uniformly in the land area, and may be positioned to preserve any great circle paths designed into the dimple pattern. It has been found that, depending on the dimple pattern, a typical ball would have between 1000 and 2500 secondary depressions in the land area of the ball. It is to be understood, however, that any number of secondary depressions may be incorporated into the ball depending the desired resultant aerodynamic and/or aesthetic effect.

All of the secondary depressions may be of the same dimension and geometry, or they may be of differing dimensions and geometry. Although any dimension and geometry is possible, preferably, the secondary depressions 14, all typically have a spherical radius with a diameter d (FIG. 2) between about 0.01" and 0.03", and a depth or height or depth h between about 0.001" and 0.005". In some embodiments, however, the diameter may range from 0.001" up to 0.05", and the height h may range from 0.001" up to 0.010". In one embodiment, 1820 roughening depressions with a diameter of 0.0212" and a depth of 0.004" were formed in the ball.

The secondary depressions may be applied with any type of dimple pattern (i.e. icosahedron, dodecahedron, random ... and with any type of dimple (circular or non-circular). Again, however, the number of secondary depressions depends on the dimple pattern and the desired aerodynamic and aesthetic effect.

The aerodynamic impact of the secondary depressions has been tested in connection with Dunlop-Maxfli Sports Corporation's BB355 ball. The BB355 ball has 380 dimples, 72 of which were 0.150" in diameter and 0.0078" in depth (height), 180 of which were 0.144" in diameter and 0.0076" in depth, and 120 of which were 0.140" in diameter and 0.0074 in depth. The pattern for the secondary depressions consisted of 1080 roughening depressions having a 0.02" diameter and a depth of 0.0035". The following table represents the results from a comparative test of the BB355 ball without the secondary roughening pattern and a BB355 ball with the roughening pattern.

| Ball | Driver Carry (yds.) | Driver Total (yds.) | Rear Trajectory (degrees) | 5 Iron Carry (yds.) | Rear Trajectory (degrees) |
|---|---|---|---|---|---|
| Without invention | 258.7 | 280.9 | 9.75 | 174.7 | 14.5 |
| With invention | 255.6 | 280.6 | 9.45 | 175.5 | 14.2 |

In the table, "Driver Carry" and "5 Iron Carry" are the average distances from the tee to the point where the balls first contacted the ground. "Driver total" is the average distance from the tee to the point where the ball comes to rest, i.e., the total distance from the tee. "Rear trajectory" is a measure of the maximum height the ball obtains during its flight, measured in degrees from the teeing point, as the angle from the ground to the ball in the air at its maximum.

From the data, it can be clearly seen that incorporation of the secondary depressions of the invention allows the same yardage as can be obtained with a ball without the depressions, but with a lower trajectory. This confirms that the ball with the secondary depressions experiences decreased drag forces compared to a ball without the secondary depressions. Advantageously, therefore, although the dimples create the overall "gross" flight aerodynamics of the ball, the roughening pattern allows "fine" adjustments, primarily to the drag force on an in-flight ball.

There is thus provided a golf ball having dimples thereon and a pattern of secondary depressions disposed in the land area between the dimples. Advantageously, the secondary depressions provide a golf ball designer with several new options in the design of dimple patterns. First, incorporation of the secondary depressions allows the lift and drag forces to be decoupled to a greater extent. Further reductions in the drag force, compared to the drag force viable under current technologies and constraints, may also be achieved using the secondary depressions according to the invention. Also, the secondary depressions allow greater flexibility in the use of surface area coverage and dimple layout for creating desired aerodynamic and aesthetic effects.

The embodiments described herein, are but some of several which utilize this invention, and are set forth here by way of illustration but not of limitation. For example, the secondary depressions can be incorporated into golf balls having a wide variety of dimple patterns. It is obvious that many other embodiments, which will be readily apparent to those skilled in the art, may be made without departing materially from the spirit and scope of this invention.

What is claimed is:

1. A golf ball comprising:

an exterior surface defining a plurality of dimples, wherein said dimples have a diameter greater than 0.10"; and a land area between said dimples; and between 1,000 and 2,500 secondary depressions located between said dimples, wherein said secondary depressions have a spherical cross-section, a depth within the range 0.001" to 0.005", and a diameter within the range 0.01" to 0.05".

2. A golf ball according to claim 1, wherein said secondary depressions are substantially identical in depth and diameter.

3. A golf ball according to claim 1, wherein 1820 of said secondary depressions are formed between said dimples.

* * * * *